US005466347A

United States Patent [19]

Shimamune et al.

[11] Patent Number: 5,466,347

[45] Date of Patent: Nov. 14, 1995

[54] METHOD FOR ELECTROLYZING AQUEOUS SOLUTION OF ALKALI CHLORIDE

[75] Inventors: Takayuki Shimamune; Yasuo Nakajima, both of Tokyo, Japan

[73] Assignees: Permelec Electrode, Ltd., Kanagawa, Japan; De Nora Permelec S.p.A., Milan, Italy

[21] Appl. No.: 162,761

[22] Filed: Dec. 7, 1993

[30] Foreign Application Priority Data

Dec. 10, 1992 [JP] Japan ..... 4-352630

[51] Int. Cl.[6] ..... C25B 1/46

[52] U.S. Cl. ..... 204/98; 204/103; 204/129; 204/128

[58] Field of Search ..... 204/98, 128, 129, 204/103

[56] References Cited

U.S. PATENT DOCUMENTS

| | | | |
|---|---|---|---|
| 3,963,592 | 6/1976 | Lindström | 204/98 |
| 4,217,186 | 8/1980 | McRae | 204/98 |
| 4,391,680 | 7/1983 | Mani et al. | 204/98 |
| 5,041,197 | 8/1991 | Gelb | 204/128 |

FOREIGN PATENT DOCUMENTS

| | | |
|---|---|---|
| 0008470 | 3/1980 | European Pat. Off. . |
| 2630589 | 10/1989 | France . |

*Primary Examiner*—John Niebling
*Assistant Examiner*—Brendan Mee
*Attorney, Agent, or Firm*—Sughrue, Mion, Zinn, Macpeak & Seas

[57] ABSTRACT

The present invention is intended to prevent the formation of impurities such as chlorate in electrolysis using the ion exchange membrane method, without resorting to the addition of hydrochloric acid to counter the migration of alkali hydroxide from the cathode compartment to the anode compartment. The method of the present invention includes feeding a portion of an aqueous solution of an alkali chloride (as the raw material) into an auxiliary electrolytic cell of the cation exchange membrane type in which the anode is a hydrogen gas electrode, thereby effecting electrolysis to generate hydrochloric acid in the anode compartment, and then feeding the hydrochloric acid-containing aqueous solution of alkali chloride into the main electrolytic cell, thereby neutralizing the alkali hydroxide which migrates from the cathode compartment. This method inherently forms hydrochloric acid in the system, obviating the need for having an additional facility for synthesis of hydrochloric acid, thus permitting the efficient production of alkali hydroxide and chlorine without the addition of hydrochloric acid.

4 Claims, 1 Drawing Sheet

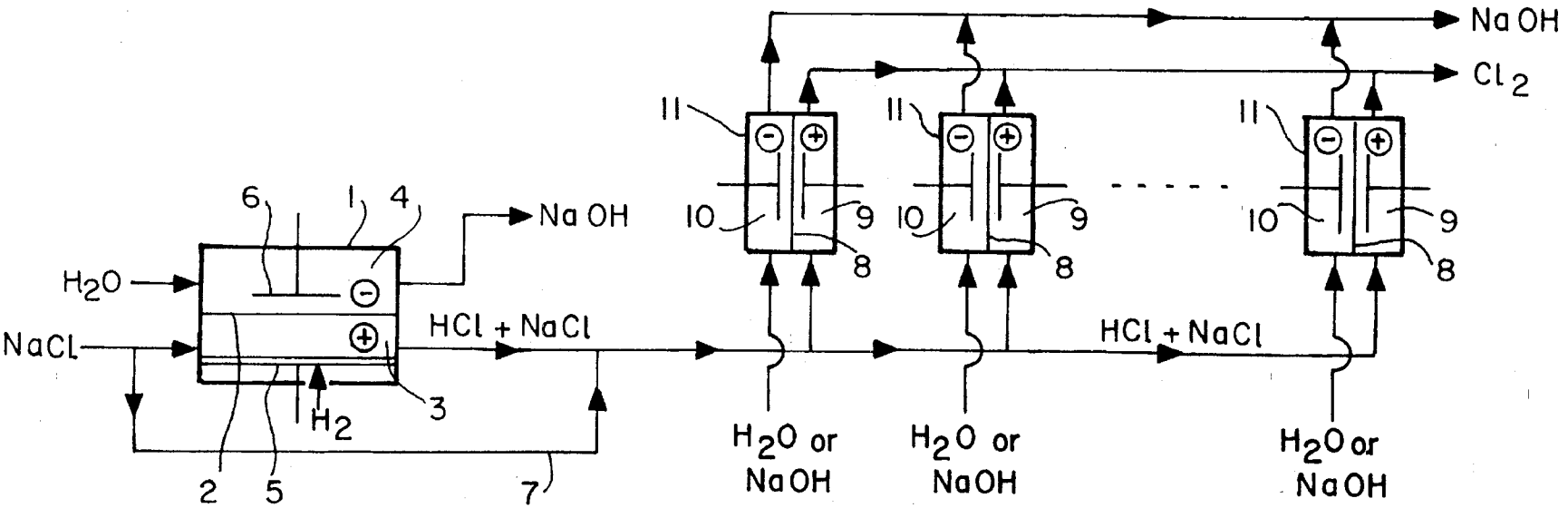
NaOH
Cl2
H2O or NaOH
HCl + NaCl
H2O or NaOH
H2O or NaOH
NaOH
HCl + NaCl
H2
H2O
NaCl
1
2
3
4
5
6
7
8
9
10
11

METHOD FOR ELECTROLYZING AQUEOUS SOLUTION OF ALKALI CHLORIDE

FIELD OF THE INVENTION

The present invention relates to a method for producing alkali hydroxide efficiently by hydrolysis of an aqueous solution of alkali chloride. More particularly, the present invention relates to a method for producing alkali hydroxide and chlorine by electrolyzing an aqueous solution of alkali chloride while suppressing the formation of impurities which have an adverse effect on the efficiency of electrolysis and the purity of products.

BACKGROUND OF THE INVENTION

The production of sodium hydroxide and chloride from an aqueous solution of alkali chloride, especially brine, by electrolysis has long been one branch of the basic chemical industries. Initially, electrolysis was carried out by using mercury as the cathode to yield alkali hydroxide and chlorine of extremely high purity. Use of the mercury method, however, is diminishing because of high energy consumption (approximately 3000 kWh/ton of alkali hydroxide) and environmental pollution with mercury. As a substitute for the mercury method, a new method has been developed which uses an asbestos diaphragm. This new method suffers from the disadvantages of forming alkali hydroxide of low purity, requiring an additional step for separating alkali hydroxide from alkali chloride, and permitting a large amount of oxygen to enter chlorine. Its advantage of low energy consumption for electrolysis is offset by high energy consumption for product purification. The overall energy consumption is equal to or more than that of the mercury method. Another disadvantage is that asbestos is a carcinogen. As a result, the ion exchange membrane method is becoming predominant in the field of alkali chloride electrolysis.

The ion exchange membrane method is designed such that a purified aqueous solution of alkali chloride (especially sodium chloride) is fed into the anode compartment (which is separated by a cation exchange membrane from the cathode compartment in the electrolytic cell) and pure water is fed into the cathode compartment as needed so as to yield chlorine in the anode compartment and alkali hydroxide (30–50%) in the cathode compartment. The energy consumption of this method is 2200–2500 kWh/ton of alkali hydroxide, which is 20–30% less than that of the other conventional method. In Japan, for example, the production of more than 80% of alkali hydroxide is by the ion exchange membrane method.

Despite its advantages, the ion exchange membrane method has a disadvantage in that up to ten percent of the alkali hydroxide formed in the cathode compartment migrates into the anode compartment through the ion exchange membrane. The ratio of the amount of alkali hydroxide excluding the migrated alkali hydroxide to the total amount of alkali hydroxide is expressed by the term of current efficiency. It is usually 90–97%, depending on the kind of the ion exchange membrane used. Not only does the migrated alkali hydroxide decrease the current efficiency in proportion to its amount, it also reacts with chlorine in the anode compartment to form chloric acid and chlorate. The major constituent of the chlorate is sodium chlorate, which is extremely stable and hardly decomposes. The accumulation of sodium chlorate decreases the solubility of alkali chloride in its aqueous solution. The decreased concentration of alkali chloride permits more oxygen to enter chlorine formed in the anode. This has an adverse effect on electrolysis itself.

This disadvantage can be eliminated by adding hydrochloric acid to the anode compartment in an amount equivalent to the current efficiency of the ion exchange membrane. The hydrochloric acid neutralizes the alkali hydroxide which has migrated from the cathode compartment through the cation exchange membrane, thereby converting the alkali hydroxide into the initial alkali chloride in the anode compartment. This prevents the adverse effect caused by the formation of sodium chlorate, and acidifies the anode compartment, which leads to improved purity of chlorine obtained.

However, the addition of hydrochloric acid poses a problem associated with the uneven distribution of acid concentration in the electrolytic cell. If the addition method is not precise, it may cause local corrosion in the various parts of the electrolytic cell. Further, it is necessary to use synthetic hydrochloric acid of high purity. In other words, it is necessary to produce hydrochloric acid from chlorine obtained by electrolysis. This lowers the efficiency of chlorine production and adds the cost for synthesis of hydrochloric acid from chlorine to the cost of the process.

SUMMARY OF THE INVENTION

It is an object of the present invention to provide a method for electrolyzing an aqueous solution of alkali chloride, said method permitting the efficient production of high-purity alkali hydroxide and chlorine without the need of adding chemicals. It is a further object of the present invention to solve the problem, which is inherent in the above-mentioned conventional ion exchange membrane method, arising from the migration of alkali hydroxide from the cathode compartment into the anode compartment.

BRIEF DESCRIPTION OF THE DRAWING

The FIGURE is a flow diagram for electrolysis of an aqueous solution of alkali chloride.

(Legend)

1 Auxiliary electrolytic cell
2 Ion exchange membrane
3 Anode compartment
4 Cathode compartment
5 Hydrogen gas electrode
6 Cathode
7 Branch tube
8 Ion exchange membrane
9 Anode compartment
10 Cathode
11 Main electrolytic cell

DETAILED DESCRIPTION OF THE INVENTION

To achieve the above and other objects, the present invention is embodied in a method for electrolyzing an aqueous solution of alkali chloride which comprises feeding a portion of an aqueous solution of alkali chloride into an auxiliary electrolytic cell of the cation exchange membrane type in which the anode is a hydrogen gas electrode, thereby effecting electrolysis to generate hydrochloric acid in the anode compartment, and feeding the hydrochloric acid-containing aqueous solution of alkali chloride, together with the remainder of the aqueous solution of alkali chloride, into the main electrolytic cell having a diaphragm of cation exchange membrane, thereby producing chlorine in the anode compartment and alkali hydroxide in the cathode compartment.

The invention will be described in more detail hereinbelow.

In the method of the present invention, a portion of an aqueous solution of alkali chloride (as the raw material for electrolysis) is fed into an auxiliary electrolytic cell in which the anode is a hydrogen gas electrode, before feeding it into the main electrolytic cell. This step generates hydrochloric acid in the anode compartment of the auxiliary electrolytic cell. The aqueous solution of alkali chloride containing hydrochloric acid and unelectrolyzed alkali chloride, together with the remainder of the aqueous solution of alkali chloride, are fed into the main electrolytic cell of ordinary ion exchange membrane type. This neutralizes the hydrochloric acid and the alkali hydroxide which have been formed by electrolysis in the cathode compartment and migrated into the anode compartment through the ion exchange membrane, and prevents the reaction between the migrated alkali hydroxide and the resulting chlorine. In this way, the present invention solves the above-mentioned problem associated with the formation of chloric acid.

The auxiliary electrolytic cell is composed of an anode compartment and a cathode compartment, which are separated from each other by a cation exchange membrane, as disclosed in EP 0522382A1. The only reaction that takes place in the anode compartment of the auxiliary electrolytic cell is $H_2 \rightarrow 2H^+ + 2e^-$ (potential 0 V) owing to hydrogen depolarization; the reaction $Cl^- \rightarrow Cl_2 + 2e^-$ (potential approximately 1.3 V) does not take place. Therefore, the potential in the anode compartment is 0 V, and what takes place in the anode compartment is merely the dissociation of salt. In the cathode compartment, alkali ions (e.g., sodium ions) react with hydroxyl ions formed in accordance with the equation $2H_2O + 2e^- \rightarrow 2OH^- + H_2$, to yield alkali hydroxide and generate hydrogen gas. On the other hand, in the anode compartment, chlorine ions in the aqueous solution of alkali chloride react with hydrogen ions formed by electrolytic dissociation to yield hydrochloric acid in accordance with the equation $Cl^- + H^+ \rightarrow HCl$. The hydrochloric acid formed in the auxiliary electrolytic cell has usually a concentration of about 1–10% by weight depending on the conditions of electrolysis (such as the ion exchange membrane used and the feed rate of the solution).

The hydrogen to be used for hydrogen depolarization in the anode compartment may be supplied from a separate hydrogen source or by circulating the hydrogen which is generated in the cathode compartment. In the former case, the cathode may be an oxygen or air cathode, because it is not necessary to generate hydrogen in the cathode compartment.

The hydrogen gas electrode in the auxiliary electrolytic cell may be a conventional gas electrode composed of a hydrophilic part and a hydrophobic part. The gas electrode may be prepared by treating one side of the substrate carrying a catalyst metal with polytetrafluoroethylene (hereinafter PTFE) to make it hydrophobic.

There is no specific restriction on the ratio of the total amount of the aqueous solution of alkali chloride to the amount of the aqueous solution of alkali chloride supplied to the auxiliary electrolytic cell. It is desirable to adjust the ratio such that when the HCl-containing aqueous solution of alkali chloride discharged from the auxiliary electrolytic cell is combined with the remaining aqueous solution of alkali chloride, the hydrochloric acid has a concentration of 0.2–5.0% by weight. The concentration of hydrochloric acid may vary so long as a certain amount of hydrochloric acid required to neutralize the alkali hydroxide migrating through the ion exchange membrane of the main electrolytic cell is supplied to the main electrolytic cell. It is desirable that the amount of hydrochloric acid to be supplied to the main electrolytic cell should be less than that required to neutralize the alkali hydroxide, because an excess amount of hydrochloric acid added to the main electrolytic cell acidifies the electrolyte in the main electrolytic cell, causing corrosion of the various parts of the cell.

An advantage of having a hydrogen gas electrode as the anode is that the total electrolytic voltage for the electrolysis of the aqueous solution of alkali chloride is about 2 V, which is about two-thirds that in the conventional electrolysis of alkali chloride. The total electrolytic voltage of 2 V is made up of the cathode equilibrium potential which is approximately 0.8 V, the anode potential 0–0.2 V, the membrane resistance 0.2–0.3 V, the solution resistance 0.2–0.3 V, the electrode overvoltage 0.2–0.3 V, and other resistances.

It is in the anode compartment of the auxiliary electrolytic cell that the hydrochloric acid and the aqueous solution of alkali chloride form. It is in the cathode compartment of the auxiliary electrolytic cell that the aqueous solution (about 10% by weight) of alkali hydroxide forms. The HCl-containing aqueous solution of alkali chloride that forms in the anode compartment is discharged from the auxiliary electrolytic cell and then combined with the aqueous solution of alkali chloride which has not been fed to the auxiliary electrolytic cell, and the mixture (which is an acid aqueous solution of alkali chloride) is fed to the main electrolytic cell. The alkali hydroxide which has formed in the auxiliary electrolytic cell may be fed to the main electrolytic cell, or used as the product, or added to the product in the main electrolytic cell.

The main electrolytic cell is an ion exchange membrane electrolytic cell which is divided by a cation exchange membrane as in the conventional electrolytic cell for alkali chloride. The anode is a dimensionally stable one composed of a titanium substrate and a coating of platinum group metal oxide, and the cathode is a nickel mesh coated with an electrode substance.

The HCl-containing acidic aqueous solution of alkali chloride which has been fed to the main electrolytic cell is electrolyzed under normal conditions to yield chlorine and alkali hydroxide in the anode compartment and cathode compartment, respectively. The alkali hydroxide partly migrates into the anode compartment through the above-mentioned ion exchange membrane. Since the anode compartment is supplied with the acidic aqueous solution of alkali chloride, the alkali hydroxide which has migrated immediately reacts with the hydrochloric acid for neutralization to yield alkali chloride. This prevents the alkali hydroxide which has migrated from being converted into chlorate etc. which adversely affects the purity.

Since the acidic aqueous solution of alkali chloride which is fed to the main electrolytic cell contains hydrochloric acid uniformly diluted and dissolved therein, there are no variations of acid concentration, unlike the conventional acidic aqueous solution which is prepared by the direct addition of hydrochloric acid. This prevents the corrosion of the various parts of the cell.

The method of the present invention will be described with reference to the accompanying drawing.

The Figure is a flow diagram for electrolysis of an aqueous solution of alkali chloride.

There is shown an auxiliary electrolytic cell 1, which is divided into an anode compartment 3 and a cathode compartment 4 by an ion exchange membrane 2. The anode compartment 3 has an anode 5, which is a hydrogen gas electrode, at the end thereof. The cathode compartment 4 has a cathode 6, which is a nickel mesh or the like. A portion of raw material brine is fed into the anode compartment 3 and the remainder of the brine is introduced to the outlet of the anode compartment 3 through a branch tube 7. Pure water is fed into the cathode compartment 4.

As the anode 5 is supplied with hydrogen gas, and the auxiliary electrolytic cell 1 is energized, hydrochloric acid forms on the anode 5 as the result of the reaction between chlorine ions (from the dissociation of sodium chloride) and hydrogen ions (from the oxidation of hydrogen gas). In the cathode compartment, alkali hydroxide forms as in the ordinary electrolysis of alkali chloride. The anode compartment 3 contains an electrolyte which is an acidic aqueous solution of alkali chloride composed of hydrochloric acid and unreacted alkali chloride. The acidic aqueous solution of alkali chloride is discharged from the electrolytic cell 1 and then combined with the remainder of the aqueous solution of alkali chloride which has been introduced through the branch tube 7. The resulting mixture is an acidic aqueous solution of alkali chloride containing dilute hydrochloric acid. In the cathode compartment 4, alkali hydroxide of low concentration is formed and may be either discharged from the auxiliary electrolytic cell 1 or fed into the cathode compartment of the main electrolytic cell.

The above-mentioned dilute acidic aqueous solution of alkali chloride is fed into the respective anode compartments 9 of the main electrolytic cells 11 arranged in parallel, each having an anode compartment 9 and a cathode compartment 10 separated from each other by an ion exchange membrane 8. The cathode compartment 10 is supplied with pure water or a dilute aqueous solution of alkali chloride. As each main electrolytic compartment 11 is energized, alkali hydroxide and hydrogen form in the cathode compartment 10 and chlorine forms in the anode compartment 9. The alkali hydroxide which forms in the cathode compartment 10 migrates into the anode compartment 9 through the ion exchange membrane 8. The alkali hydroxide reacts with hydrochloric acid present in the anode compartment 9, forming alkali chloride and water, faster than it reacts with chloride. This prevents the formation of chlorate, etc. Moreover, the presence of hydrochloric acid prevents the entrance of oxygen into chlorine. Thus it is possible to produce high-purity chlorine gas.

EXAMPLES

The invention will be described with reference to the following examples which demonstrates the electrolysis of an aqueous solution of alkali chloride. The example is not intended to restrict the scope of the invention. Unless otherwise indicated, percents are by weight.

EXAMPLE 1

Twenty electrolytic cells, each having an electrolytic surface 50 mm wide and 200 mm high, were made ready for use. To prepare a hydrogen gas electrode, a carbon cloth, 220 mm long and 70 mm wide, was deposited with platinum (0.5 mg/cm$^2$), and one side thereof was treated with PTFE to make it hydrophobic.

This hydrogen gas electrode was attached to one of the twenty electrolytic cells. The electrolytic cell was divided into an anode compartment and a cathode compartment by a cation exchange membrane of sulfonic acid type ("Nafion 324" produced by E. I. Du Pont de Nemours and Company). The anode compartment was provided with an inlet for the aqueous solution of sodium chloride. The cathode compartment was provided with an inlet for pure water. The anode and cathode compartments comprise the auxiliary electrolytic cell. Each of the remaining 19 electrolytic cells was divided into an anode compartment and a cathode compartment by a cation exchange membrane ("Nafion 90209" produced by E. I. Du Pont de Nemours and Company). The anode compartment was equipped with a titanium mesh (as the anode), 200 mm long and 50 mm wide, coated with platinum-iridium (70:30) alloy. The cathode compartment was equipped with a nickel mesh (as the cathode) coated with Raney nickel. The anode and cathode compartments comprise the main electrolytic cell. The main electrolytic cells were connected in parallel.

The inlet for aqueous solution of sodium chloride attached to the auxiliary electrolytic cell is provided with a branch tube. The end of the branch tube is led to the vicinity of the outlet of the anode compartment, so that the acidic aqueous solution of sodium chloride discharged from the anode compartment is mixed with the aqueous solution of sodium chloride from the branch tube, to yield a dilute acidic aqueous solution of sodium chloride, which is subsequently fed to the anode compartment of each of the main electrolytic cells.

Electrolysis was carried out at a current density of 30 A/dm$^2$ and an electrolytic voltage of 2.1 V, with the anode compartment and cathode compartment of the auxiliary electrolytic cell supplied respectively with 30% of saturated aqueous solution of sodium chloride and pure water. It was found that the acidic aqueous solution of sodium chloride discharged from the anode compartment contained 1.7% hydrochloric acid and the concentration of sodium hydroxide discharged from the cathode compartment was 10%. The current efficiency was about 97%.

The acidic aqueous solution of sodium chloride was mixed with the remainder (70%) of the aqueous solution of sodium chloride supplied through the branch tube. The resulting mixed solution was fed to each of the anode compartment of the 19 main electrolytic cells. Electrolysis was carried out for 1 week at a current density of 30 A/dm$^2$ and an electrolytic voltage of 3.1–3.2 V. The pH of the anode liquid remained stable at 3–3.5. It was found that the chlorine gas discharged from the anode compartment contained 0.2% oxygen and that there was substantially no formation of chlorate. It was also found that the sodium hydroxide discharged from the cathode compartment had a concentration of 32%, and that the ion exchange membrane in the main electrolytic cell yielded a current efficiency of 95% for the formation of sodium hydroxide.

COMPARATIVE EXAMPLE 1

Electrolysis was carried out under the same conditions as in Example 1, except that the aqueous solution of sodium chloride was not fed to the auxiliary electrolytic cell but was fed to the main electrolytic cell. The ion exchange membrane yielded a current efficiency of 95% for the formation of sodium hydroxide, as in Example 1. However, the resulting chlorine gas had a low purity, with an oxygen concentration as high as 1.0%, and the cathode liquid was found to contain about 2% chlorate.

The present invention is embodied in a method for electrolyzing an aqueous solution of alkali chloride which comprises feeding a portion of an aqueous solution of alkali chloride into an auxiliary electrolytic cell of cation exchange membrane type in which the anode is a hydrogen gas electrode, thereby effecting electrolysis to generate hydrochloric acid in the anode compartment, and feeding the hydrochloric acid-containing aqueous solution of alkali chloride, together with the remainder of the aqueous solution of alkali chloride, into the main electrolytic cell having a diaphragm of cation exchange membrane, thereby producing chlorine in the anode compartment and alkali hydroxide in the cathode compartment.

According to the present invention, a portion of an aqueous solution of alkali chloride (as the raw material for electrolysis) is fed into an auxiliary electrolytic cell in which the anode is a hydrogen gas electrode, before it is fed into the main electrolytic cell. Electrolysis is effected to generate hydrochloric acid in the anode compartment of the auxiliary electrolytic cell. The aqueous solution of alkali chloride containing hydrochloric acid is mixed with the remainder of the aqueous solution of alkali chloride, and the mixture is fed into the main electrolytic cell. The hydrochloric acid neutralizes the alkali hydroxide which has formed by electrolysis in the cathode compartment and migrated into the anode compartment through the ion exchange membrane. This prevents the reaction between the migrated alkali hydroxide and the resulting chlorine. In this way, it is possible to produce high-purity alkali hydroxide and chlorine, while preventing the formation of chlorate which has an adverse effect on the solubility of alkali chloride.

It has been conventional practice in electrolysis of alkali chloride to add hydrochloric acid to avoid the adverse effect caused by the migration of alkali hydroxide. The addition of hydrochloric acid is troublesome and needs an additional step for synthesis of hydrochloric acid. Moreover, it poses a problem associated with the uneven distribution of hydrochloric acid, which causes the corrosion of the various parts of the electrolytic cell.

According to the present invention, it is not necessary to synthesize and add hydrochloric acid because hydrochloric acid is produced in the system. Moreover, there is no possibility of corrosion because hydrochloric acid is uniformly dissolved.

Further, alkali hydroxide is also formed in the auxiliary electrolytic cell. In other words, none of the electrolytic cells is wasted. It is thus possible to produce high-purity alkali hydroxide while maintaining high production efficiency.

While the invention has been described in detail with reference to specific embodiments, it will be apparent to one skilled in the art that various changes and modifications can be made to the invention without departing from its spirit and scope.

What is claimed is:

1. A method for electrolyzing an aqueous solution of alkali chloride, comprising the steps of:

feeding a portion of an original aqueous solution of alkali chloride into an auxiliary electrolytic cell containing a cation exchange membrane in which the anode is a hydrogen gas electrode, thereby effecting electrolysis and generating a hydrochloric acid-containing aqueous solution of alkali chloride in an anode compartment of said auxiliary electrolytic cell and alkali hydroxide and hydrogen gas in the cathode compartment of said auxiliary electrolytic cell; and feeding the hydrochloric acid-containing aqueous solution of alkali chloride, together with the remainder of the original aqueous solution of alkali chloride, into a main electrolytic cell having a diaphragm of cation exchange membrane, thereby producing chlorine in an anode compartment of said main electrolytic cell and alkali hydroxide in a cathode compartment of said main electrolytic cell.

2. The method for electrolyzing an aqueous solution of alkali chloride claimed in claim 1, wherein about 30% by weight of said original aqueous solution of alkali chloride is fed into said auxiliary electrolytic cell.

3. A method for electrolyzing an aqueous solution of sodium chloride, comprising the steps of:

feeding a portion of an original aqueous solution of sodium chloride into an auxiliary electrolytic cell containing a cation exchange membrane in which the anode is a hydrogen gas electrode, thereby effecting electrolysis and generating a hydrochloric acid-containing aqueous solution of sodium chloride in an anode compartment of said auxiliary electrolytic cell and alkali hydroxide and hydrogen as in the cathode compartment of said auxiliary electrolytic cell; and feeding the hydrochloric acid-containing aqueous solution of sodium chloride, together with the remainder of the original aqueous solution of sodium chloride, into a main electrolytic cell having a diaphragm of cation exchange membrane, thereby producing chlorine in an anode compartment of said main electrolytic cell and sodium hydroxide in a cathode compartment of said main electrolytic cell.

4. The method for electrolyzing an aqueous solution of sodium chloride claimed in claim 3, wherein about 30% by weight of said original aqueous solution of sodium chloride is fed into said auxiliary electrolytic cell.

* * * * *